US006135930A

United States Patent [19]

Kuo

[11] Patent Number: 6,135,930

[45] Date of Patent: Oct. 24, 2000

[54] EXERCISE DEVICE FOR RECUPERATION

[76] Inventor: Kevin Yen-Fu Kuo, 38, Flowervale Road, Thornhill ON, Canada, L3T 4J4

[21] Appl. No.: 09/229,745

[22] Filed: Jan. 14, 1999

[51] Int. Cl.[7] ..... A63B 69/06

[52] U.S. Cl. ..... 482/72; 482/71; 482/57; 482/96

[58] Field of Search ..... 482/72, 71, 57, 482/96; 601/24, 33–35

[56] References Cited

U.S. PATENT DOCUMENTS

| | | | |
|---|---|---|---|
| 5,520,599 | 5/1996 | Chen | 482/96 |
| 5,580,340 | 12/1996 | Yu | 482/96 |
| 5,611,758 | 3/1997 | Rodgers, Jr. | 482/57 |

*Primary Examiner*—Jerome W. Donnelly
*Assistant Examiner*—Lori Amerson
*Attorney, Agent, or Firm*—Browdy and Neimark

[57] ABSTRACT

An exercise device consists of a bottom frame having a frame body, and a leg frame disposed at rear end of the frame body for tilting the frame body, a carrying unit having a seat mounted on the frame body, and a backrest mounted on the frame body, two action units having a pedal rod rotatably fastened at one end thereof with the frame body and at other end thereof with a pedal, a holding frame fastened pivotally with the frame body, a linking member connecting the pedal rod with the holding frame, and a damping device disposed at a pivoting end of the pedal rod. A linking device is disposed at the bottom of the frame body and connected with the linking members for enabling the two action units to operate in opposite directions.

9 Claims, 4 Drawing Sheets

EXERCISE DEVICE FOR RECUPERATION

FIELD OF THE INVENTION

The present invention relates generally to an exercise device, and more particularly to an exercise device designed to assist a patient to recuperate.

BACKGROUND OF THE INVENTION

A patient is often advised or required to undertake a physical therapy in the aftermath of an operation, so as to speed up the recuperation. However, there are very few exercise devices that are specifically intended for use in the recuperation.

SUMMARY OF THE INVENTION

The primary objective of the present invention is therefore to provide an exercise device designed for use in the recuperating of a patient.

In keeping with the principle of the present invention, the foregoing objective of the present invention is attained by an exercise device consisting of a bottom frame having a frame body, a leg frame disposed at the rear end of the frame body such that the frame body is tilted, a carrying unit, two action units disposed at two opposite sides of the frame body such that the two action units are corresponding in location to the carrying unit. The two action units are composed of a pedal rod, a pedal board, a holding frame, a linking mechanism, and a damping device. A linking device enables the two action units to act in opposite directions such that a first pedal rod is moved downwards to bring about a rearward deflection of the holding frame corresponding to the first pedal rod, and that a second pedal rod is moved upwards to bring about a forward deflection of the holding frame corresponding to the second pedal rod.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
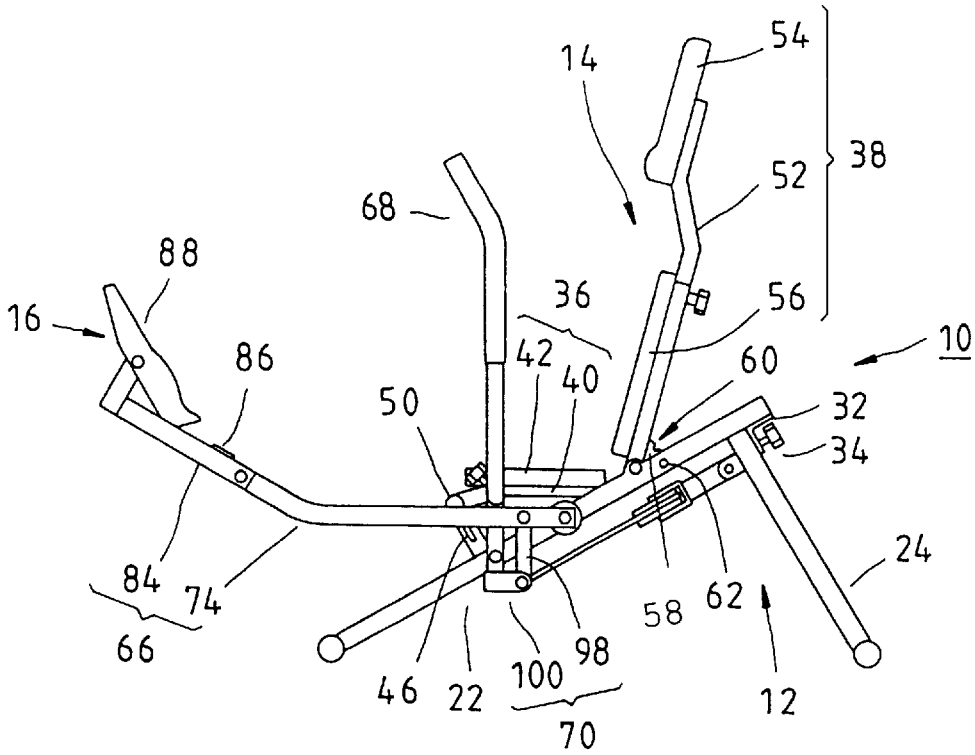
FIG. 1 shows a side elevation view of the preferred embodiment of the present invention.
Figure 2:
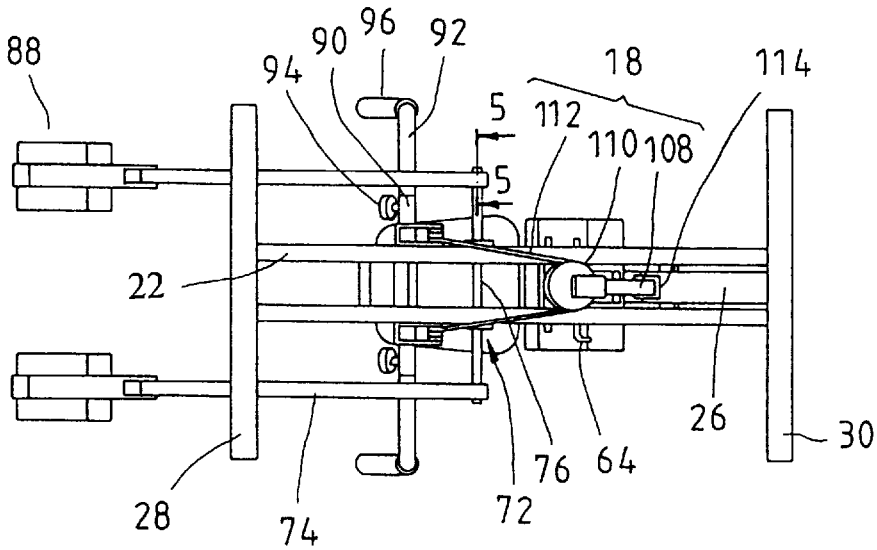
FIG. 2 shows a bottom view of the preferred embodiment of the present invention.
Figure 3:
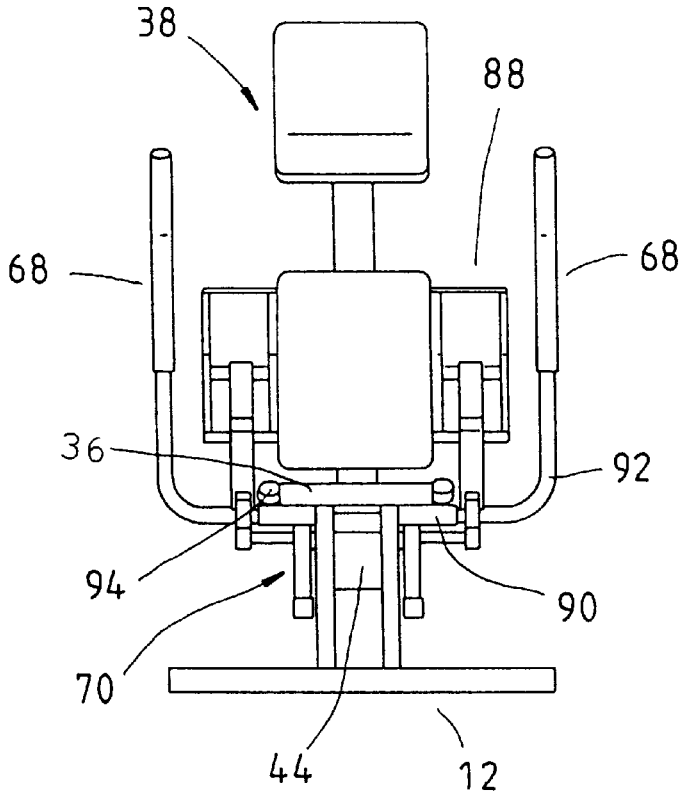
FIG. 3 shows a left view of the preferred embodiment of the present invention.
Figure 4:
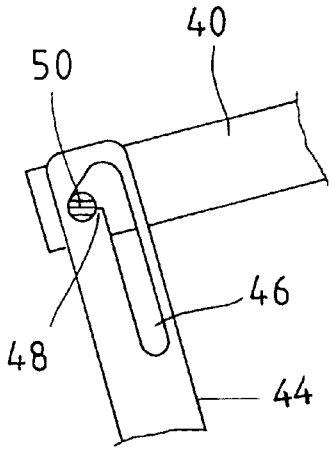
FIG. 4 shows a schematic view of a bearing rod of the seat of the preferred embodiment of the present invention.
Figure 5:
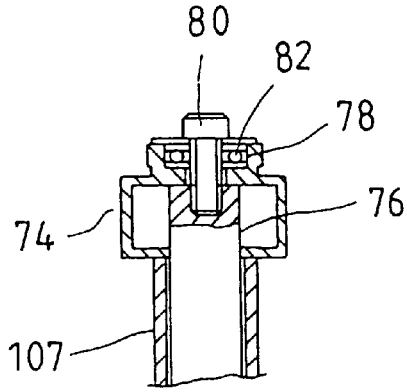
FIG. 5 shows a sectional view taken along the direction indicated by a line 5—5 as shown in FIG. 2.
Figure 6:
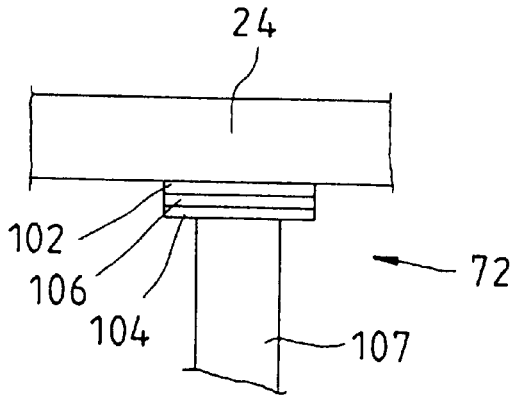
FIG. 6 shows a schematic view of the damping device of the preferred embodiment of the present invention.

As shown in FIGS. 1–6, an exercise device 10 embodied in the present invention is composed of a bottom frame 12, a carrying unit 14 mounted on the bottom frame 12, two action units 16 mounted on two sides of the bottom frame 12, and a linking device 18 mounted on the bottom of the bottom frame 12 and connected with the two action units 16.

The bottom frame 12 is formed of a frame body 22 and a leg frame 24. The leg frame 24 has a rod body 26 which is fastened pivotally with the rear end of leg frame 24 such that leg frame 24 is tilted forwardly. The front end of the body 24 and the bottom end of frame body 22 are provided respectively with a bottom rod 28, 30 which is fastened therewith by welding, for enabling the bottom frame 12 to rest securely on a surface. The leg frame 24 is provided at the rear end thereof with a fastening plate 32 fastened therewith by welding for a locking member 34 to lock the rod body 26 with the fastening plate 32.

The carrying unit 14 consists of a seat 36 and a backrest 38. The seat 36 has a bearing rod 40, and a soft pad 42 fastened with the bearing rod 40. The bearing rod 40 has one end which is disposed on a bearing seat 44 of the body 22. The bearing seat 44 is provided with a guide slot 46 which is in turn provided in an upper end thereof with a bearing cavity 48 corresponding in location to the front end of the bottom frame 12. A bolt 50 is disposed in the guide slot 46 and fastened securely with the bearing rod 40, so as to retain one end of the seat 36 in the bearing cavity 48 by the bolt 50 such that the one end of the seat 36 is parallel with a floor surface. The backrest 38 has a placing rod 52, and two soft pads 54 and 56 which are disposed respectively at both ends of the placing rod 52. The placing rod 52 is fastened pivotally at the bottom end thereof with the body 22. A locating block 58 is fastened to one side of the bottom end of the placing rod 52 by welding and is provided in the periphery thereof with a plurality of first locating holes 60. The body 22 is provided with a second locating hole 62 corresponding in location to the locating block 58. The backrest 38 is located by a pin 64 which is received in the first locating hole 60 and the second locating hole 62 such that the backrest 38 and the body 22 form an appropriate angle.

The two action units 16 are composed of a pedal rod 66, a holding frame 68, a linking member 70, and a damping device 72.

The pedal rod 66 has a hollow base rod 74, which is disposed at one end of the damping device 72 and is engaged with one end of a cross rod 76 of the body 22. The base rod 74 is provided in the outer side thereof with a bearing cavity 78 for receiving a ball bearing 82 in conjunction with a bolt 80, so as to enable the base rod 74 to turn on the cross rod 76. An end rod 84 of pedal rod 66 is fastened pivotally with one end of the base rod 74 such that the top side of the pivoting end of the end rod 84 is provided with an arresting block 86 for locating the end rod 84 in the extending direction of the base rod 74. A pedal 88 is fastened pivotally with one end of the end rod 84.

The holding frame 68 has a hollow base support 90, which is fastened pivotally with the body 22. A grip 92 has one end which is engaged with the base support 90. The grip 92 is provided with a plurality of locating holes (not shown in the drawing) for a locking member 94 of the base support 90 to engage a predetermined locating hole, so as to locate the grip 92 at an appropriate position. The end of the grip 92 is covered with a layer of foam cotton 96.

The linking member 70 consists of a first connection rod 98 and a second connection rod 100. The first connection rod 98 is fastened pivotally at one end thereof with the inner side of the base rod 74. The second connection rod 100 is fastened at one end thereof with one end of the base support 90 by welding.

The damping device 72 has two ring-shaped clamping pieces 102 and 104, a ring-shaped friction piece 106, and a hollow connection rod 107, which are all disposed on the cross rod 76. The two clamping places 102 and 104 are welded respectively to the body 24 and one end of the connection rod 107. The friction piece 106 is disposed between the two clamping pieces 102 and 104 for bringing about a damping force to prevent the two clamping pieces 102 and 104 from turning in relation to each other. The connection rod 107 is fastened at other end thereof with the base rod 74.

The linking device 18 is composed of a bearing frame 108, a standing pulley 110, and a rope 112. The bearing frame 108 is fastened pivotally at one end thereof with a pivoting seat 114, and at other end thereof with the standing pulley 110. The rope 112 is wound on the standing pulley 110 such that both ends of the rope 112 are fastened with the pivoting portions of the first connection rods 98 and the second connection rods 100. As one linking member 70 moves toward the front end of the bottom frame 12, other linking member 70 is pulled by the rope 112 to move toward the rear end of the bottom frame 12.

Figure 7:
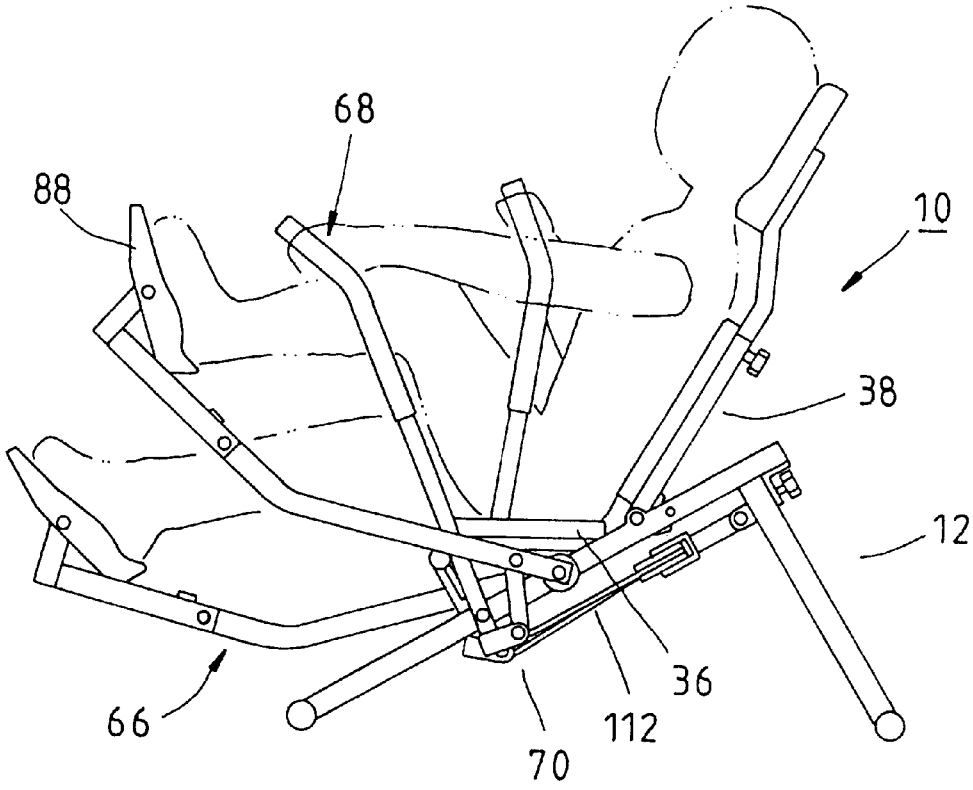
FIGS. 7 and 8 are schematic views of the preferred embodiment of the present invention in action.
Figure 8:
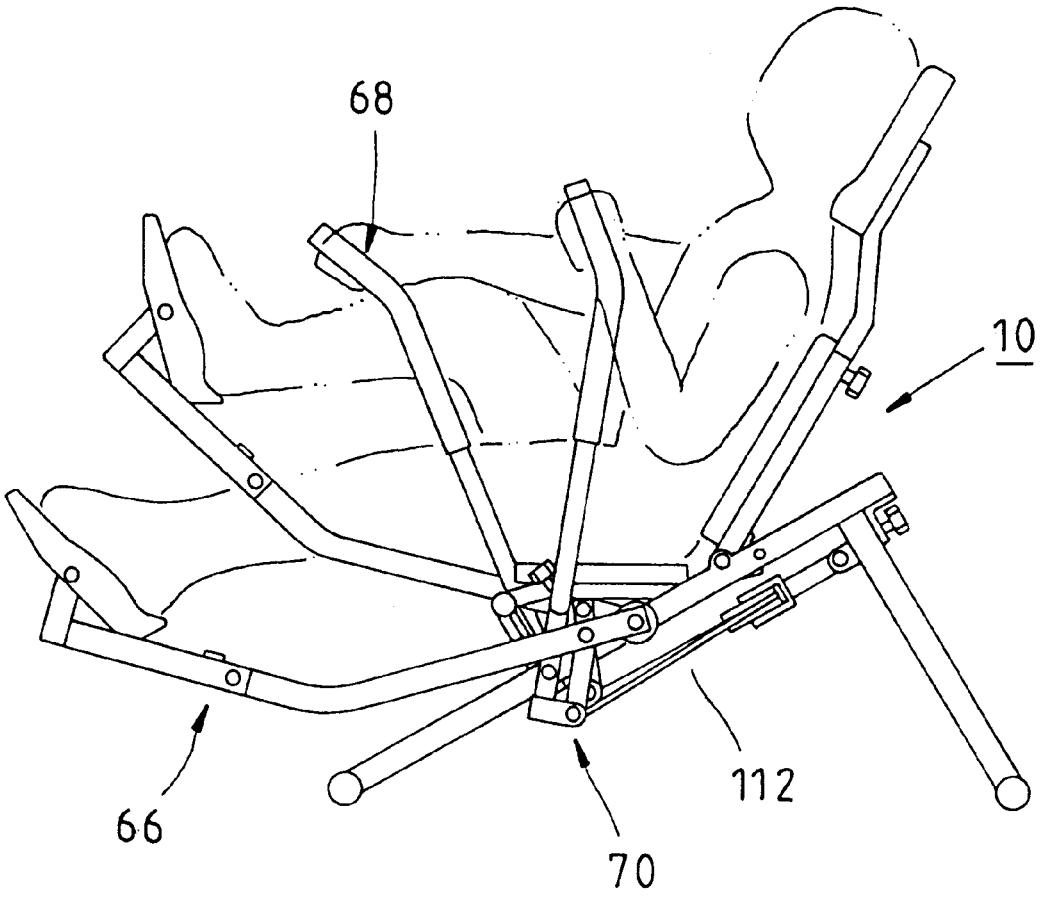

In operation, a user of the exercise device 10 of the present invention is seated on the seat 36 such that his or her back leans against the backrest 38, and that his or her hands hold the two grips 92, and further that his or her feet are rested on the pedals 88. Now referring to FIG. 7, when the pedal rod 66 is pushed downward by the right foot of the user of the exercise device 10, the linking member 70 deflects clockwise to move toward the lower side of the front, thereby actuating the holding frame 68 to swivel toward the rear so as to cause the elbows of the user to move rearwards. When the linking member 70 moves forwardly, the rope 112 is pulled so as to enable the left linking member 70 to be pulled to the rear. As a result, the left pedal 88 is caused to move in opposite direction along with the grip 92, thereby causing the pedal 88 to rise and the grip 92 to swivel forwardly. On the contrary, as shown in FIG. 8, when the left foot of the user moves downwards, the left pedal 88 rises. In the meantime, the grip 92 swivels forwardly, thereby causing the right pedal 88 to rise and the grip 92 to swivel forwardly. The user's trunk is thus stretched.

In the event that the user of the exercise device 10 is recuperating from the hand injuries, the user may make use of his or her foot to pedal forcefully the pedal 88 so as to cause the pedal rods 66 and the grips 92 to swivel in such a manner as described above. Both hands can be thus stretched. On the contrary, if the user of the exercise device 10 is recuperating from the leg injuries, the grip 92 can be moved easily with hand to actuate the pedal rod 66 and the grip 92 to act in such a way as described above. The legs can be thus stretched. The damping device 72 is intended to provide a recuperating action with an appropriate damping force.

Before putting the exercise device 10 away for storage, the locking member 34, the pin 64, and the locking member 94 are first disengaged to enable the leg frame 24 and the backrest 38 to move lower. In the meantime, the grips 92 are dismantled. The end rods 84 are moved in reverse to rest against the base rod 74. The exercise device 10 is thus made compact.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise device comprising:

a bottom frame having a frame body, a leg frame disposed at a first end of said frame body for tilting said frame body toward a second end of said frame body;

a carrying unit consisting of a seat mounted on said frame body, and a backrest mounted on said frame body;

two action units disposed on two opposite sides of said frame body and corresponding to said carrying unit, said two action units consisting of pedal 66 rod rotatably fastened at a first end thereof with a side of said frame body, and a pedal fastened with a second end of said pedal rod;

a holding frame fastened pivotally with said frame body;

a linking member connecting said pedal rod with a trace end of said holding frame;

a damping device disposed at a pivoting end of said pedal rod; and a linking device disposed at a bottom of aid frame body connected with said linking member for causing said two action units to operate in opposite directions;

wherein said holding frame has a hollow base support fastened pivotally with said frame body, a grip connected with said base support provided with a plurality of locating holes, and a locking member disposed on said base frame for locking a predetermined locating hole of said locating holes so as to fasten said grip with said base support; and wherein, when said pedal rod of one of said two action units moves downward when said pedal is exerted on by an external force, said holding frame is deflected rearward, one of said pedal rod of said two action units is displaced upward and said holding frame is deflected forward.

2. The exercise device as defined in claim 1, wherein said seat has a bearing rod which is fastened pivotally at one end thereof with said frame body, said seat further having a pad which is mounted on said bearing rod.

3. The exercise device as defined in claim 1, wherein said backrest has a placing rod which is fastened pivotally at first end thereof with said frame body such that said placing rod swivels to form an angle with said frame body, said backrest further having two pads disposed respectively on said first end and a second end of said placing rod.

4. The exercise device as defined in claim 3, wherein said backrest further comprises a locating block fixed at said first end of said placing rod opposite to a side of said frame body, said locating block provided with a plurality of first locating holes, said frame body provided with a second locating hole corresponding in location to said locating block, said locating block and said frame body being fastened together by a pin which is received in said second locating hole and one of said first locating hole.

5. The exercise device as defined in claim 1, wherein said damping device is mounted on a cross rod of said frame body such that said damping device is fastened at one end thereof with said pedal rod which is disposed on said cross rod.

6. The exercise device as defined in claim 5, wherein said damping device has two ring-shaped clamping pieces, a ring-shaped friction piece, and a hollow connection rod connected with said cross rod, said two clamping pieces being fastened respectively with said frame body and one end of said connection rod, said friction piece being disposed between said two clamping pieces, said connection rod being fastened at other end thereof with said pedal rod.

7. The exercise device as defined in claim 5, wherein said pedal rods have a hollow base rod which is engaged with said cross rod and connected with said damping device, said pedal rods further having an end rod which is fastened pivotally at one end of said base rod, and an arresting block disposed at a pivoting end of said end rod and pressed against said base rod, said pedal being fastened pivotally with one end of said end rod.

8. The exercise device as defined in claim 1, wherein said linking members are two connection rod mechanisms.

9. The exercise device as defined in claim 8, wherein said linking device has a bearing frame fastened pivotally with said leg frame and corresponding to a bottom of said frame body, a standing pulley mounted on said bearing frame, and a rope wound on said standing pulley such that both ends of said rope are connected with two pivoting portions of said linking members.

* * * * *